US008659375B2

(12) United States Patent
Nakahashi et al.

(10) Patent No.: US 8,659,375 B2
(45) Date of Patent: Feb. 25, 2014

(54) REED SWITCH

(75) Inventors: Shunji Nakahashi, Fukuoka (JP); Kenjiro Hamada, Fukuoka (JP); Yoichi Wakabayashi, Fukuoka (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 0 days.

(21) Appl. No.: 13/364,326

(22) Filed: Feb. 2, 2012

(65) Prior Publication Data

US 2012/0235774 A1 Sep. 20, 2012

(30) Foreign Application Priority Data

Mar. 16, 2011 (JP) ..... 2011-058390

(51) Int. Cl.
*H01H 1/66* (2006.01)

(52) U.S. Cl.
USPC ..... 335/151; 335/133

(58) Field of Classification Search
USPC ..... 335/151
See application file for complete search history.

(56) References Cited

U.S. PATENT DOCUMENTS 2,450,499 A * 10/1948 Brown ..... 335/154
2,921,160 A * 1/1960 Lautzenhiser ..... 335/126
2,987,593 A * 6/1961 Alley ..... 335/154
3,059,075 A * 10/1962 Peek, Jr. ..... 335/154
3,117,202 A * 1/1964 Werts ..... 335/153
3,146,327 A * 8/1964 Yoshitami et al. ..... 200/241
3,155,792 A * 11/1964 Werts ..... 335/206
3,166,652 A * 1/1965 Werts ..... 335/153
3,194,986 A * 7/1965 Belek et al. ..... 327/493
3,250,866 A * 5/1966 Ryno ..... 335/206
3,317,869 A * 5/1967 Funke ..... 335/154
3,320,559 A * 5/1967 Morrison ..... 335/151
3,321,702 A * 5/1967 Tuccinardi ..... 324/259
3,334,320 A * 8/1967 Frank ..... 335/154
3,348,175 A * 10/1967 Wilkis ..... 335/154
3,349,352 A * 10/1967 Zandt ..... 335/154
3,356,974 A * 12/1967 Funke ..... 335/154
3,478,287 A * 11/1969 Harrett ..... 335/154
3,541,482 A * 11/1970 Brown ..... 335/154
3,586,809 A * 6/1971 Santi ..... 200/263
3,602,851 A * 8/1971 Wiegand ..... 335/146
RE27,315 E * 3/1972 Santi ..... 335/154
3,701,960 A * 10/1972 Campbell ..... 335/154

(Continued)

FOREIGN PATENT DOCUMENTS

JP 58-161216 9/1983

*Primary Examiner* — Elvin G Enad
*Assistant Examiner* — Lisa Homza
(74) *Attorney, Agent, or Firm* — Ditthavong Mori & Steiner, P.C.

(57) ABSTRACT

A reed switch includes an envelope. First and second fixed terminal pieces are at one end of the envelope. A third fixed terminal piece is at another end of the envelope. A movable reed piece has a base end portion facing the one end portion of the third fixed terminal piece across a magnetic gap, a distal end portion to contact the first fixed terminal piece, and a movable contact portion. A first spring member has a base end portion secured to the first fixed terminal piece and a distal end portion to contact the movable contact portion. A second spring member has a base end portion secured to the second fixed terminal piece and a distal end portion to contact the movable contact portion. A third spring member has one and another end portions respectively secured to the movable reed piece and the third fixed terminal piece.

12 Claims, 7 Drawing Sheets

(56) References Cited

U.S. PATENT DOCUMENTS

| | | | | | |
|---|---|---|---|---|---|
| 3,711,795 | A | * | 1/1973 | Martelli | 335/151 |
| 3,720,894 | A | * | 3/1973 | Greenwood | 335/204 |
| RE28,220 | E | * | 10/1974 | Ratliff et al. | 335/154 |
| 3,928,828 | A | * | 12/1975 | Kato et al. | 335/152 |
| 3,952,271 | A | * | 4/1976 | Smirnov et al. | 335/151 |
| 4,011,533 | A | * | 3/1977 | Santi | 335/154 |
| 4,063,203 | A | * | 12/1977 | Fujiwara et al. | 335/154 |
| 4,149,130 | A | * | 4/1979 | Lacis et al. | 335/154 |
| 4,363,011 | A | * | 12/1982 | Turczanski | 335/154 |
| 4,618,842 | A | * | 10/1986 | Nestlen et al. | 335/128 |
| 4,980,526 | A | * | 12/1990 | Reneau | 200/61.45 M |
| 5,909,163 | A | * | 6/1999 | Posey | 335/151 |

* cited by examiner

Step SB1

Step SB2

Step SB3

Step SB4

Step SB5

Step SC1

Step SC2

Step SC3

Step SC4

Step SC5

REED SWITCH

CROSS-REFERENCE TO RELATED APPLICATIONS

The present application claims priority under 35 U.S.C. §119 to Japanese Patent Application No. 2011-058390, filed Mar. 16, 2011. The contents of this application are incorporated herein by reference in their entirety.

BACKGROUND OF THE INVENTION

1. Field of the Invention

The present invention relates to a reed switch.

2. Discussion of the Background

Japanese Unexamined Patent Application Publication No. 1983-161216 discloses a reed switch. The reed switch includes a nonmagnetic envelope. In the nonmagnetic envelope, a first fixed terminal piece and a second fixed terminal piece are partially and hermetically sealed. To the second fixed terminal piece, one end of a support piece of conductive spring material is secured. The other end of the support piece extends toward the sealed part of the first fixed terminal piece. To the support piece, a magnetic piece of magnetic material is secured. The magnetic piece includes an armature disposed opposite another armature on the sealed part of the first fixed terminal piece across a magnetic gap. A moving contact is attached to the magnetic piece. A contact piece is engaged with an end portion of the sealed part of the first fixed terminal piece with a spring pressure. The contact piece has a protrusion that serves as a fixed contact to come into and out of contact with the moving contact. The reed switch is of the Form A type, where the contact closes upon application of an external magnetic field.

SUMMARY OF THE INVENTION

According to one aspect of the present invention, a reed switch includes an envelope, a first fixed terminal piece, a second fixed terminal piece, a third fixed terminal piece, a movable reed piece, a first spring member, a second spring member, and a third spring member. The envelope has one end and another end. The first fixed terminal piece is at the one end of the envelope. The first fixed terminal piece has one end portion inside the envelope and another end portion outside the envelope. The second fixed terminal piece is spaced apart from the first fixed terminal piece at the one end of the envelope. The second fixed terminal piece has one end portion inside the envelope and another end portion outside the envelope. The third fixed terminal piece is at the other end of the envelope. The third fixed terminal piece has one end portion inside the envelope and another end portion outside the envelope. The movable reed piece is inside the envelope. The movable reed piece has a base end portion, a distal end portion, and a movable contact portion. The base end portion faces the one end portion of the third fixed terminal piece across a magnetic gap. The distal end portion is configured to come into contact with the first fixed terminal piece. The movable contact portion is further centerward than the distal end portion in a longitudinal direction of the reed switch. The first spring member has a base end portion secured to the first fixed terminal piece and a distal end portion configured to come into contact with the movable contact portion. The second spring member has a base end portion secured to the second fixed terminal piece and a distal end portion configured to come into contact with the movable contact portion.

The third spring member has one end portion secured to the movable reed piece and another end portion secured to the third fixed terminal piece.

According to another aspect of the present invention, a reed switch includes an envelope, a first fixed terminal piece, a second fixed terminal piece, a third fixed terminal piece, a movable reed piece, a first spring member, a second spring member, a third spring member. The envelope has one end and another end. The first fixed terminal piece is at the one end of the envelope. The first fixed terminal piece has one end portion inside the envelope and another end portion outside the envelope. The second fixed terminal piece is spaced apart from the first fixed terminal piece at the one end of the envelope. The second fixed terminal piece has one end portion inside the envelope and another end portion outside the envelope. The third fixed terminal piece is at the other end of the envelope. The third fixed terminal piece has one end portion inside the envelope and another end portion outside the envelope. The movable reed piece is inside the envelope. The movable reed piece has a base end portion, a distal end portion, and a movable contact portion. The base end portion faces the one end portion of the third fixed terminal piece across a magnetic gap. The distal end portion is configured to come into contact with at least one of the first fixed terminal piece and the second fixed terminal piece. The movable contact portion is further centerward than the distal end portion in a longitudinal direction of the reed switch. The first spring member has a base end portion secured to the first fixed terminal piece and a distal end portion configured to come into contact with the movable contact portion. The second spring member has a base end portion secured to the second fixed terminal piece and a distal end portion configured to come into contact with the movable contact portion. The third spring member has one end portion secured to the movable reed piece and another end portion secured to the third fixed terminal piece.

According to the other aspect of the present invention, a reed switch includes an envelope, a first fixed terminal piece, a fixed reed piece, a second fixed terminal piece, a third fixed terminal piece, a movable reed piece, a first spring member, a second spring member, and a third spring member. The envelope has one end and another end. The first fixed terminal piece is at the one end of the envelope. The first fixed terminal piece has one end portion inside the envelope and another end portion outside the envelope. The fixed reed piece has a distal end portion and extending centerward from the one end portion of the first fixed terminal piece in a longitudinal direction of the reed switch. The second fixed terminal piece is spaced apart from the first fixed terminal piece at the one end of the envelope. The second fixed terminal piece has one end portion inside the envelope and another end portion outside the envelope. The third fixed terminal piece is at the other end of the envelope. The third fixed terminal piece has one end portion inside the envelope and another end portion outside the envelope. The movable reed piece is inside the envelope. The movable reed piece has a base end portion, a distal end portion, and a movable contact portion. The base end portion faces the one end portion of the third fixed terminal piece across a magnetic gap. The distal end portion is configured to come into contact with the fixed reed piece. The movable contact portion is further centerward than the distal end portion in a longitudinal direction of the reed switch. The first spring member has a base end portion secured to the fixed reed piece and a distal end portion configured to come into contact with the movable contact portion. The second spring member has a base end portion secured to the second fixed terminal piece and a distal end portion configured to come into contact with the movable contact portion. The third spring member has one end portion secured to the movable reed piece and another end portion secured to the third fixed terminal piece.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
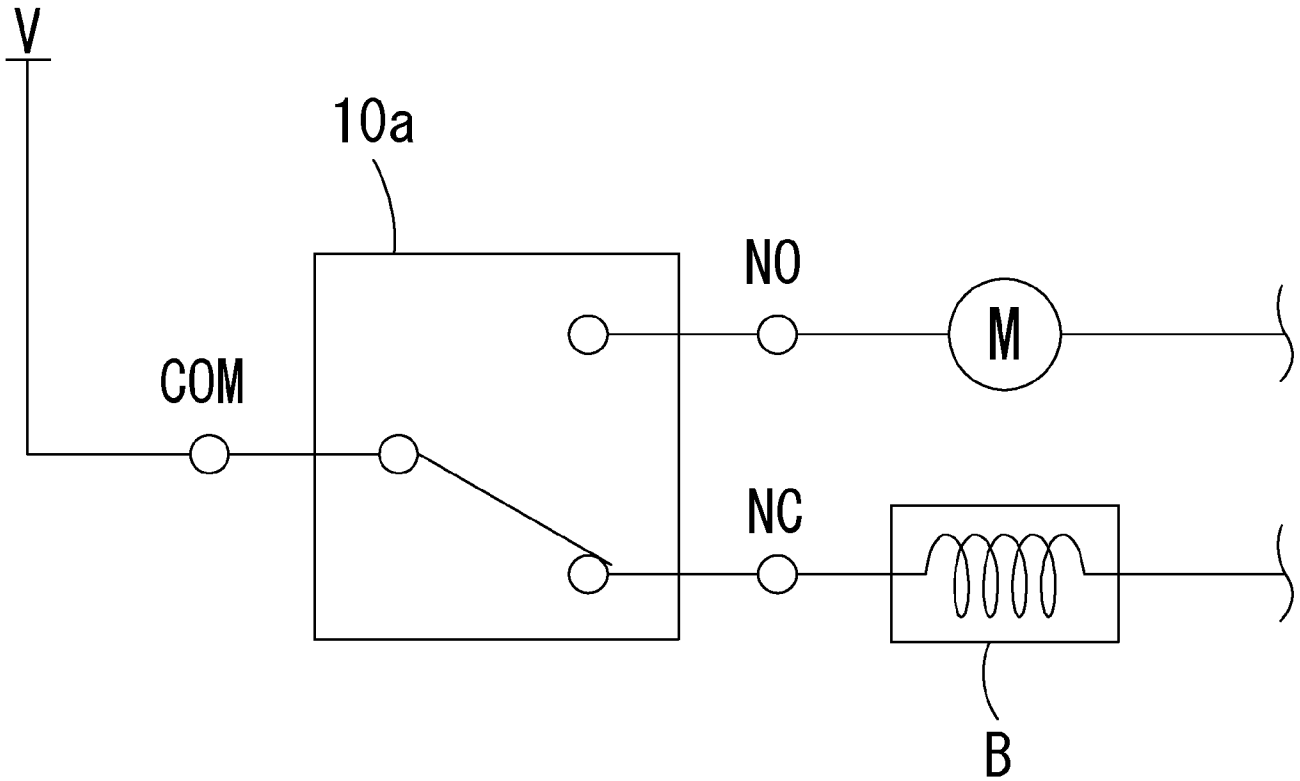
FIG. 1 is a circuit diagram illustrating a reed switch according to a first embodiment of the present invention.

The embodiments will now be described with reference to the accompanying drawings, wherein like reference numerals designate corresponding or identical elements throughout the various drawings.

First Embodiment

A reed switch 10*a* according to the first embodiment is applicable to, for example, a motor control circuit shown in FIG. 1.

The reed switch 10*a* is of the Form C type. The reed switch 10*a* has a COM terminal coupled to an electric power supply V, a NO terminal coupled to a motor M, and a NC terminal coupled to an electromagnetic brake B of the motor M.

As shown in FIG. 1, when the motor M is stationary, the electric power supply V is coupled only to the electromagnetic brake B to operate the electromagnetic brake B. In contrast, when the motor M is in motion, an external magnetic field is applied to the reed switch 10*a* to couple the electric power supply V only to the motor M. As a result, the electromagnetic brake B is released to rotate the motor M.

Figure 2:
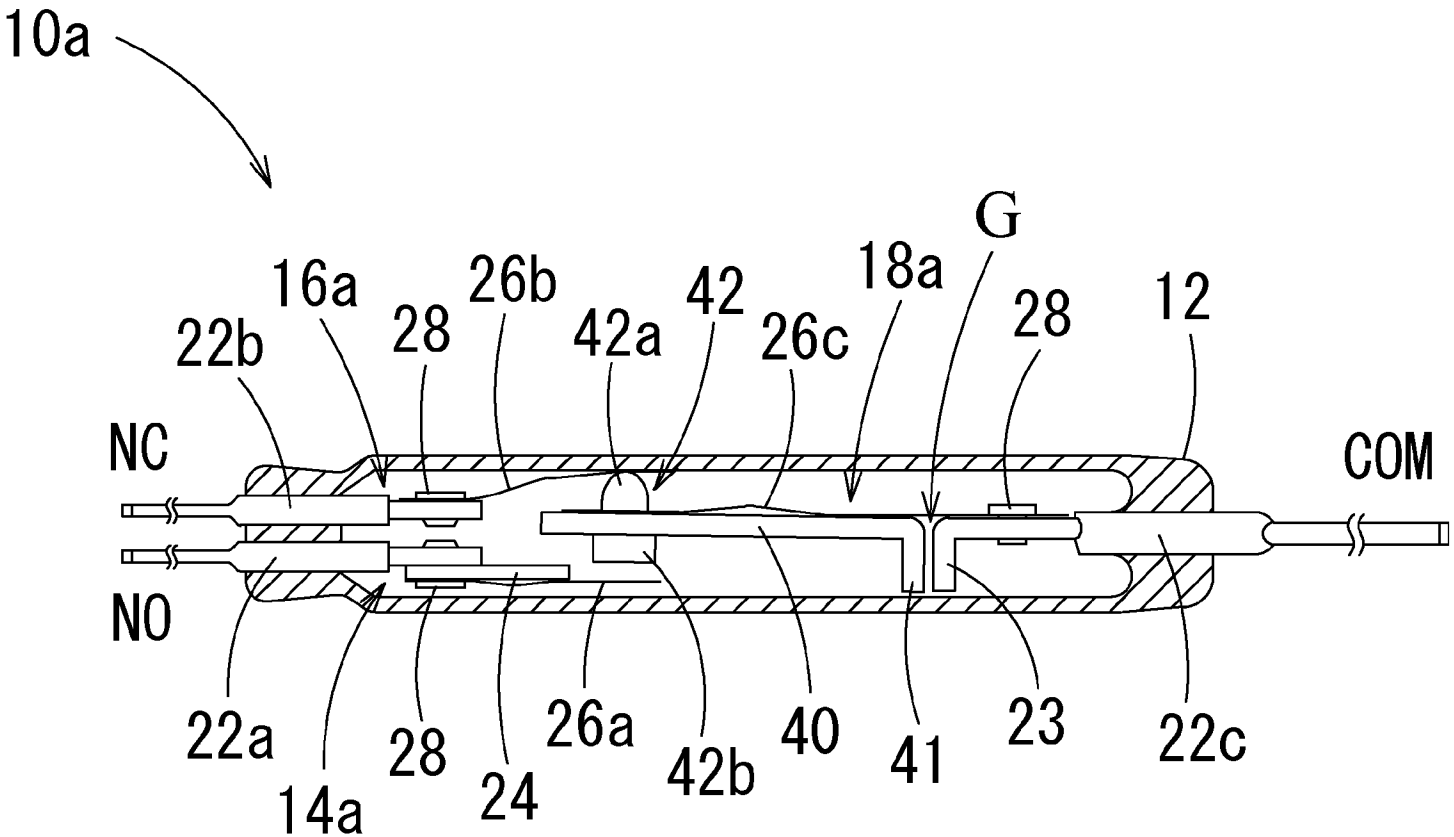
FIG. 2 is a longitudinal sectional view of the reed switch.

As shown in FIG. 2, the reed switch 10*a* includes an envelope 12, a first terminal unit 14*a*, a second terminal unit 16*a*, and a third terminal unit 18*a*. The first terminal unit 14*a*, the second terminal unit 16*a*, and the third terminal unit 18*a* each are made of a conductive material.

The envelope 12 is nonmagnetic. Examples include, but not limited to, glass. The envelope 12 contains inert gas. Examples include, but not limited to, nitrogen and helium.

The first terminal unit 14*a* includes a first fixed terminal piece 22*a* constituting the NO terminal, a fixed reed piece 24, and a first spring member 26*a*.

The first fixed terminal piece 22*a* is disposed at an end of the envelope 12, and has one end portion inside the envelope 12 and another end portion outside the envelope 12.

The first fixed terminal piece 22*a* is made of a magnetic material (such as Nickel-iron alloy, which applies throughout the description that follows).

The fixed reed piece 24 extends centerward from the one end portion (which is a distal end portion inside the envelope 12) of the first fixed terminal piece 22*a* in the longitudinal direction of the reed switch 10*a*. The fixed reed piece 24 has a base end portion, and in plan view, the top face of the base end portion is secured to the bottom face of the distal end portion of the first fixed terminal piece 22*a*. The fixed reed piece 24 is made of a magnetic material.

The first spring member 26*a* has a base end portion secured to the bottom face of the base end portion of the fixed reed piece 24, and extends centerward from the distal end portion of the fixed reed piece 24 in the longitudinal direction of the reed switch 10*a*. The base end portion of the first spring member 26*a* is caulked by the caulking pin 28 and thereby secured to the first fixed terminal piece 22*a* together with the base end portion of the fixed reed piece 24. As shown in FIG. 2, the first spring member 26*a* has a downward protrusion at a position further centerward than the base end portion in the longitudinal direction of the reed switch 10*a*. This ensures that a spring force F1 (see Step SA5 in FIG. 3) is generated in the upward direction in side view.

The first spring member 26*a* is made of a nonmagnetic material (such as molybdenum, which applies throughout the description that follows). It should be noted, however, that the first spring member 26*a* may be made of a magnetic material.

A movable contact portion 42, described later, is configured to come into contact with the distal end portion of the first spring member 26*a*.

The second terminal unit 16*a* includes a second fixed terminal piece 22*b* constituting the NC terminal and a second spring member 26*b*.

The second fixed terminal piece 22*b* is disposed at the one end of the envelope 12 and spaced apart from the first fixed terminal piece 22*a* in a direction orthogonal to the longitudinal direction (that is, in the upper direction in side view). The second fixed terminal piece 22*b* has one end portion inside the envelope 12 and another end portion outside the envelope 12.

The second fixed terminal piece 22*b* is made of a magnetic material. It should be noted, however, that the second fixed terminal piece 22*b* may be made of a nonmagnetic material, since no flux path, described later, is generated on the second fixed terminal piece 22*b*.

The second spring member 26*b* has a base end portion secured to the top face of a distal end portion of the second fixed terminal piece 22*b* in side view. The base end portion of the second spring member 26*b* is caulked by the caulking pin 28 and thereby secured to the second fixed terminal piece 22*b*. As shown in FIG. 2, the second spring member 26*b* has a bent portion at a position further centerward than the base end portion in the longitudinal direction of the reed switch 10*a*. This ensures that a spring force F2 (see Step SA1 in FIG. 3) is generated in the downward direction in side view.

The second spring member 26*b* is made of a nonmagnetic material. It should be noted, however, that the second spring member 26*b* may be made of a magnetic material.

The movable contact portion 42, described later, is configured to come into contact with the distal end portion of the second spring member 26*b*.

The third terminal unit 18*a* includes a third fixed terminal piece 22*c* constituting the COM terminal, a movable reed piece 40, and a third spring member 26*c*.

The third fixed terminal piece 22*c* is disposed at the other end of the envelope 12 and has one end portion (which is a distal end portion inside the envelope 12) inside the envelope 12 and another end portion outside the envelope 12. The distal end portion of the third fixed terminal piece 22*c* inside the envelope 12 is bent downward in side view to form a bent portion 23.

The third fixed terminal piece 22*c* is made of a magnetic material.

The movable reed piece 40 has a base end portion at the side of the one end portion (which is the distal end portion inside the envelope 12) of the third fixed terminal piece 22*c*. The end portion of the movable reed piece 40 at the side of the third fixed terminal piece 22*c* is bent downward in side view to form a bent portion 41. The bent portion 41 of the movable reed piece 40 and the bent portion 23 of the third fixed terminal piece 22*c* face one another across a magnetic gap G.

The movable reed piece 40 has a movable contact portion 42 further centerward than the distal end portion in the longitudinal direction of the reed switch 10*a*. The movable contact portion 42 protrudes in the upward and downward directions. As an upper portion of the movable contact portion 42, an upper movable contact portion 42*a* is configured to come into contact with the distal end portion of the second spring member 26*b*, as described above. The distal end portion of the upper movable contact portion 42*a* tapers toward its tip. As a lower portion of the movable contact portion 42, a lower movable contact portion 42*b* is configured to come into contact with the distal end portion of the first spring member 26*a*, as described above. The lower movable contact portion 42*b* has a cylindrical shape.

The movable reed piece 40 is made of a magnetic material.

The third spring member 26*c* has one end portion secured to the movable reed piece 40 and another end portion secured to the third fixed terminal piece 22*c*. Specifically, the one end portion of the third spring member 26*c* is caulked by the movable contact portion 42 and thereby secured to the movable reed piece 40. The other end portion of the third spring member 26*c* is caulked by the caulking pin 28 and thereby secured to the third fixed terminal piece 22*c*.

The third spring member 26*c* is configured to generate a spring force F3 (see Step SA1 in FIG. 3) against the movable reed piece 40 in the direction in which the upper movable contact portion 42*a* is brought into contact with the second spring member 26*b*.

The third spring member 26*c* is made of a nonmagnetic material. It should be noted, however, that the third spring member 26*c* may be made of a magnetic material.

The first spring member 26*a*, the second spring member 26*b*, and the third spring member 26*c* respectively have spring constants K1, K2, and K3, which are set as follows.

The spring constant K3 of the third spring member 26*c* is smaller than the spring constant K1 of the first spring member 26*a* (K3<K1).

The spring constant K2 of the second spring member 26*b* has a first case and a second case, namely, where the spring constant K2 is smaller than the spring constant K3 of the third spring member 26 (K2<K3<K1), and where the spring constant K2 is larger than the spring constant K1 of the first spring member 26*a* (K3<K1<K2).

Next, an operation of the reed switch 10*a* will be described. Upon change from a state without a magnetic field applied from outside to a state with a magnetic field applied from outside, the reed switch 10*a* operates according to steps SA1 to SA5 shown in FIG. 3.

Step SA1

Without a magnetic field applied from outside, the third spring member 26*c* keeps the upper movable contact portion 42*a* in contact with the second spring member 26*b*.

In the first case, K2<K3<K1, the second spring member 26*b* is urged to the inner surface side of the envelope 12 and thus comes into contact with the upper movable contact portion 42*a* in a bent state. In some cases, the urged second spring member 26*b* comes into contact with the inner surface of the envelope 12.

In the second case, K3<K1<K2, the second spring member 26*b* comes into contact with the upper movable contact portion 42*a* with approximately no bending.

Step SA2

With a magnetic field applied from outside, the attracting force between the magnetized movable reed piece 40 and the magnetized fixed reed piece 24 becomes larger than the thrusting force of the third spring member 26*c* against the upper movable contact portion 42*a* toward the second spring member 26*b*. This separates the upper movable contact portion 42*a* from the second spring member 26*b*.

Figure 3:
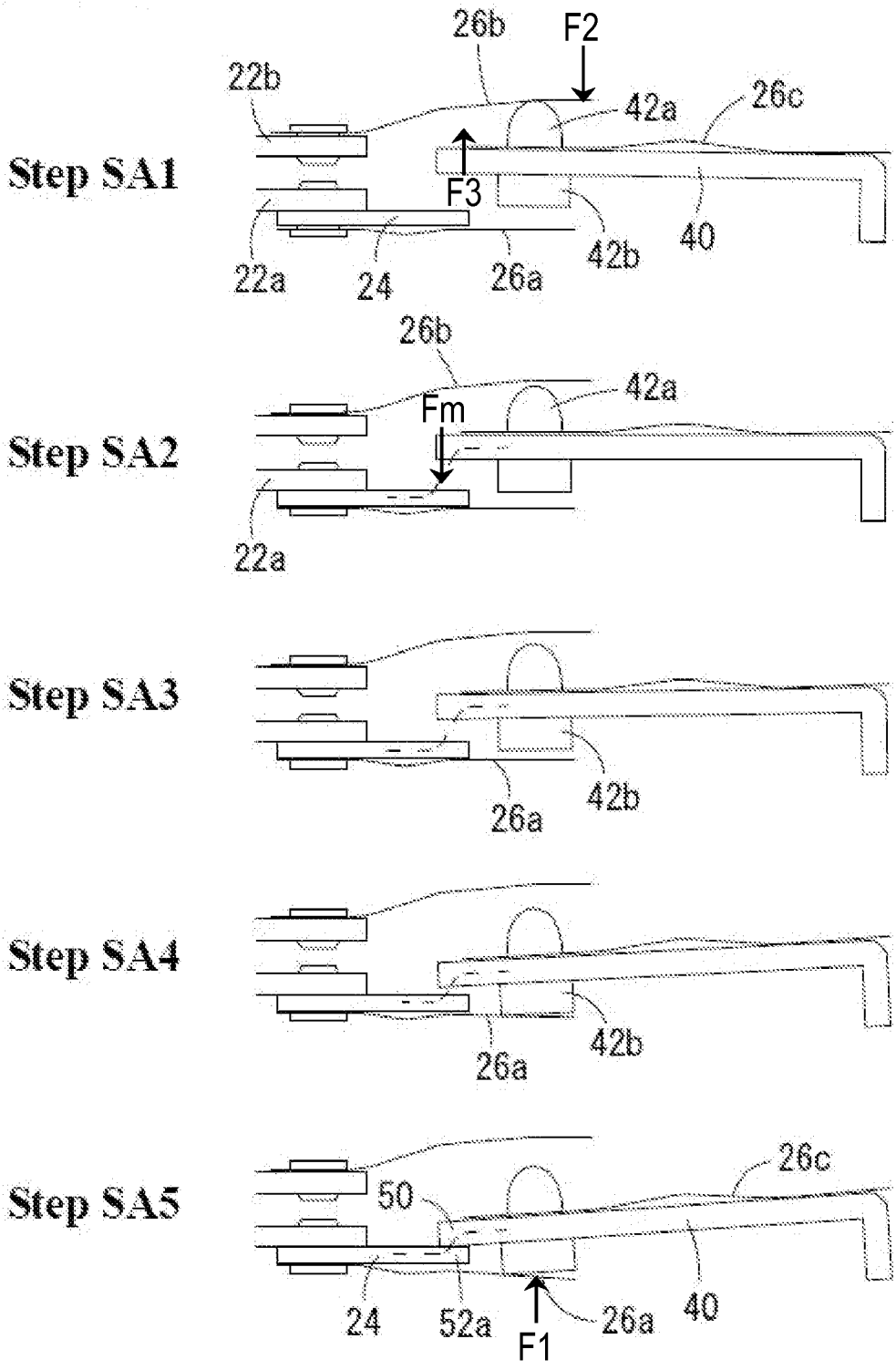
FIG. 3 is a diagram illustrating an operation of the reed switch.

In FIG. 3, the dashed lines each indicate a part of the flux path resulting from the magnetic field applied from outside.

Step SA3

The lower movable contact portion 42*b* approaches the first spring member 26*a*.

Step SA4

The lower movable contact portion 42*b* comes into contact with the first spring member 26*a*.

Step SA5

The gap between the movable reed piece 40 and the fixed reed piece 24 diminishes. The attracting force, Fm (see Step SA2 in FIG. 3), between the movable reed piece 40 and the fixed reed piece 24 is larger than the spring force F3 of the third spring member 26*c* and the spring force F1 of the first spring member 26*a* combined. Hence, the movable reed piece 40 thrusts down the first spring member 26*a*.

Finally, the lower side of the distal end portion (that is, a moving magnetic armature 50) of the movable reed piece 40 comes into contact with the upper side of the distal end portion (that is, a fixed magnetic armature 52*a*) of the fixed reed piece 24.

The spring force F1 (spring constant K1) of the first spring member 26*a* is sufficiently large such that the spring constant K1 is larger than the spring constant K3 of the third spring member 26*c*, as described above. This ensures sufficient contact pressure between the moving magnetic armature 50 and the fixed magnetic armature 52*a*.

With the magnetic field no longer applied from outside, the reed switch 10*a* operates according to the steps in reverse (that is, step SA5, step SA4, step SA3, step SA2, and step SA1).

Specifically, with the magnetic field no longer applied, the movable reed piece 40 receives the combined force of the spring force F1 of the first spring member 26*a* and the spring force F3 of the third spring member 26*c*. The combined force urges the movable reed piece 40 in the direction in which to come into contact with the second spring member 26*b*. The difference between the spring force F3 of the third spring member 26*c* and the spring force F2 of the second spring member 26*b* keeps the upper movable contact portion 42*a* and the second spring member 26*b* in contact with one another.

Thus, the reed switch 10*a* is of the Form C type, where the COM terminal is coupled to the NO terminal or the NC terminal depending on the presence of an external magnetic field.

The NO terminal of the reed switch 10*a* has a "double contact structure", where two internal couplings are established, which are at the distal end portion of the movable reed piece 40 and the movable contact portion 42.

Second Embodiment

A reed switch 10*b* according to the second embodiment will be described. Identical reference numerals designate corresponding or identical elements throughout the drawings, and therefore such elements will not be further elaborated here.

Figure 4:
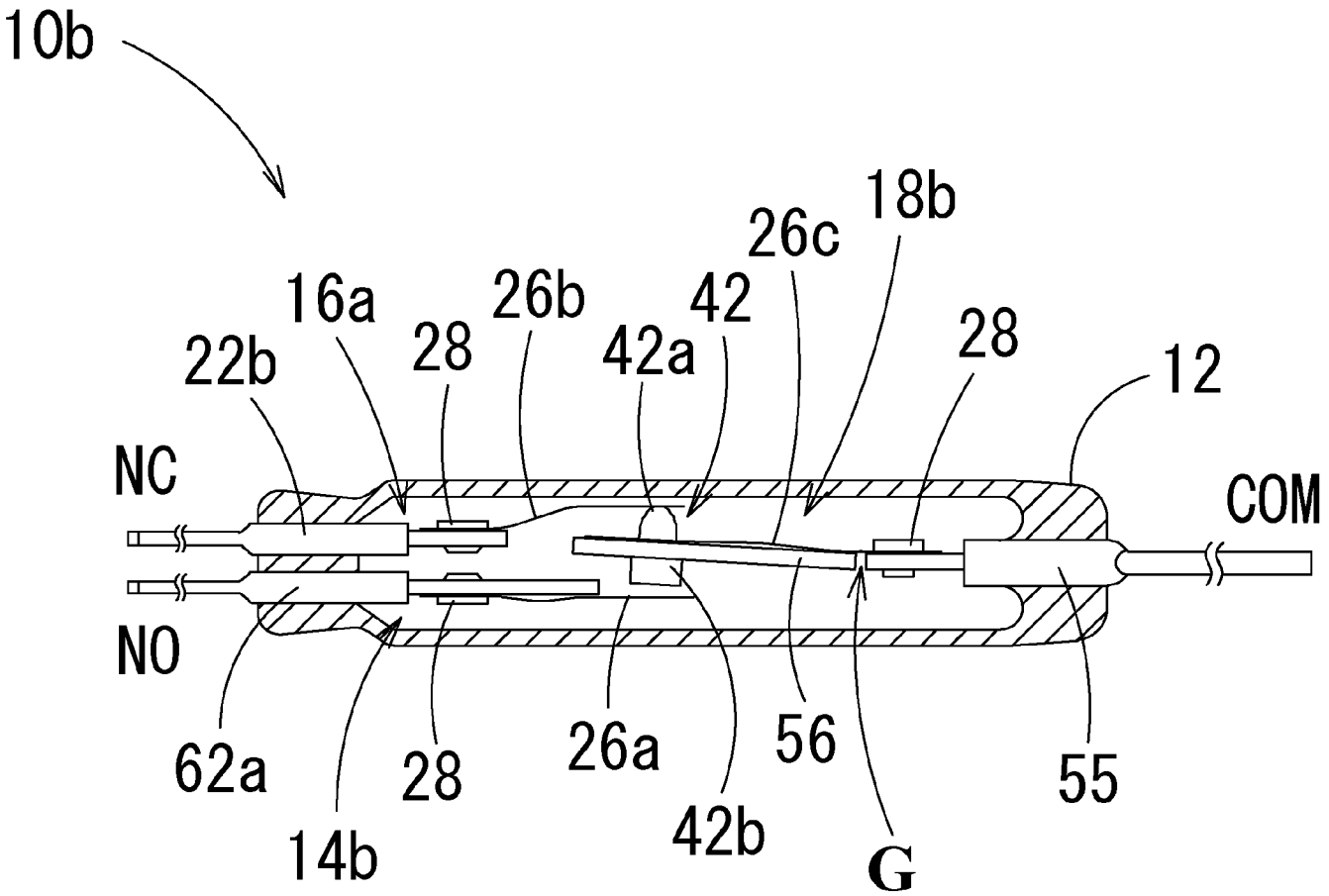
FIG. 4 is a longitudinal sectional view of the reed switch according to a second embodiment of the present invention.

The first terminal unit is a feature of the reed switch 10*b* according to the second embodiment, as compared with the reed switch 10*a* according to the first embodiment. Specifically, as shown in FIG. 4, the first terminal unit 14*b* of the reed switch 10*b* according to the second embodiment has a first fixed terminal piece 62*a*. The first fixed terminal piece 62*a*, however, is not provided with the fixed reed piece 24 (see FIG. 2), which, in the first embodiment, extends centerward from the one end portion (which is the distal end portion inside the envelope 12) of the first fixed terminal piece 22*a*.

The third terminal unit is another feature of the reed switch 10*b* according to the second embodiment, as compared with the reed switch 10*a* according to the first embodiment. Specifically, the reed switch 10*b* has a third terminal unit 18*b*, which has a movable reed piece 56 and a third fixed terminal piece 55. The feature is that the base end portion of the movable reed piece 56 and the distal end portion of the third fixed terminal piece 55 are not bent. Accordingly, the magnetic gap G is defined between the end face of the base end portion of the movable reed piece 56 and the end face of the distal end portion of the third fixed terminal piece 55 facing the end face of the base end portion of the movable reed piece 56.

Next, an operation of the reed switch 10*b* will be described. Upon change from a state without a magnetic field applied from outside to a state with a magnetic field applied from outside, the reed switch 10*b* operates according to steps SB1 to SB5 shown in FIG. 5.

Step SB1

Without a magnetic field applied from outside, the third spring member 26*c* keeps the upper movable contact portion 42*a* in contact with the second spring member 26*b*.

In the first case, K2<K3<K1, the second spring member 26*b* is urged to the inner surface side of the envelope 12 and thus comes into contact with the upper movable contact portion 42*a* in a bent state. In some cases, the urged second spring member 26*b* comes into contact with the inner surface of the envelope 12.

In the second case, K3<K1<K2, the second spring member 26*b* comes into contact with the upper movable contact portion 42*a* with approximately no bending.

Step SB2

With a magnetic field applied from outside, the attracting force between the magnetized movable reed piece 56 and the first fixed terminal piece 62*a* becomes larger than the thrusting force of the third spring member 26*c* against the upper movable contact portion 42*a* toward the second spring member 26*b*. This separates the upper movable contact portion 42*a* from the second spring member 26*b*.

Figure 5:
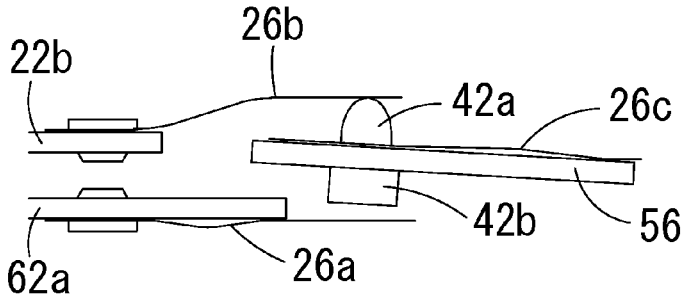
FIG. 5 is a diagram illustrating an operation of the reed switch.
Figure 5:
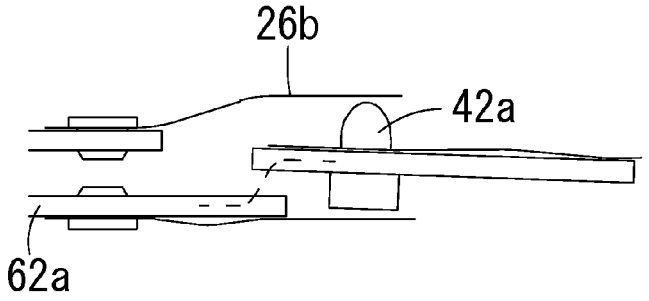
Figure 5:
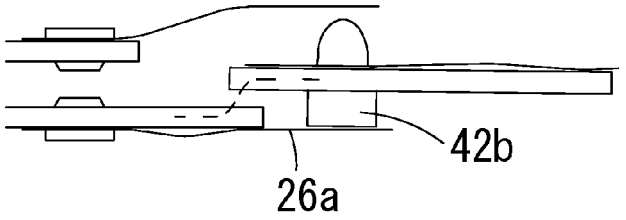
Figure 5:
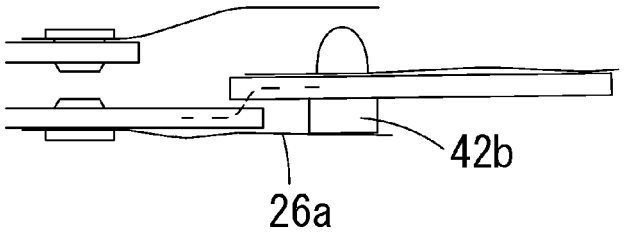
Figure 5:
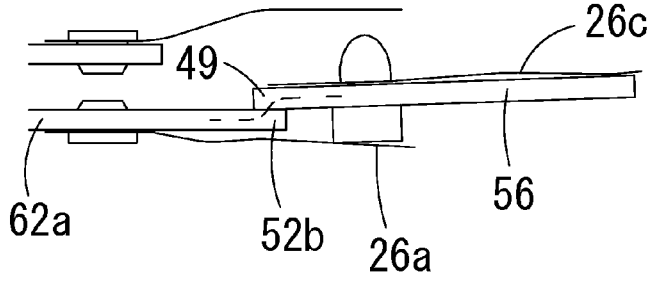

In FIG. 5, the dashed lines each indicate a part of the flux path resulting from the magnetic field applied from outside.

Step SB3

The lower movable contact portion 42*b* approaches the first spring member 26*a*.

Step SB4

The lower movable contact portion 42*b* comes into contact with the first spring member 26*a*.

Step SB5

The gap between the movable reed piece 56 and the first fixed terminal piece 62*a* diminishes. The attracting force, Fm, between the movable reed piece 56 and the first fixed terminal piece 62*a* is larger than the spring force F3 of the third spring member 26*c* and the spring force F1 of the first spring member 26*a* combined. Hence, the movable reed piece 56 thrusts down the first spring member 26*a*.

Finally, the lower side of the distal end portion (which is a moving magnetic armature 49) of the movable reed piece 56 comes into contact with the upper side of the distal end portion (which is a fixed magnetic armature 52*b*) of the first fixed terminal piece 62*a*.

The spring force F1 (spring constant K1) of the first spring member 26*a* is sufficiently large such that the spring constant K1 is larger than the spring constant K3 of the third spring member 26*c*, as described above. This ensures sufficient contact pressure between the moving magnetic armature 49 and the fixed magnetic armature 52*b*.

With the magnetic field no longer applied from outside, the reed switch 10*b* operates according to the steps in reverse (that is, step SB5, step SB4, step SB3, step SB2, and step SB1).

Specifically, with the magnetic field no longer applied, the movable reed piece 56 receives the combined force of the spring force F1 of the first spring member 26*a* and the spring force F3 of the third spring member 26*c*. The combined force urges the movable reed piece 56 in the direction in which to come into contact with the second spring member 26*b*. The difference between the spring force F3 of the third spring member 26*c* and the spring force F2 of the second spring member 26*b* keeps the upper movable contact portion 42*a* and the second spring member 26*b* in contact with one another.

Thus, the reed switch 10*b* is of the Form C type, where the COM terminal is coupled to the NO terminal or the NC terminal depending on the presence of an external magnetic field.

The NO terminal of the reed switch 10*b* has a "double contact structure", where two internal couplings are established, which are at the distal end portion of the movable reed piece 56 and the movable contact portion 42.

Third Embodiment

A reed switch 10*c* according to the third embodiment of the present invention will be described below. Identical reference numerals designate corresponding or identical elements throughout the drawings, and therefore such elements will not be further elaborated here.

Figure 6:
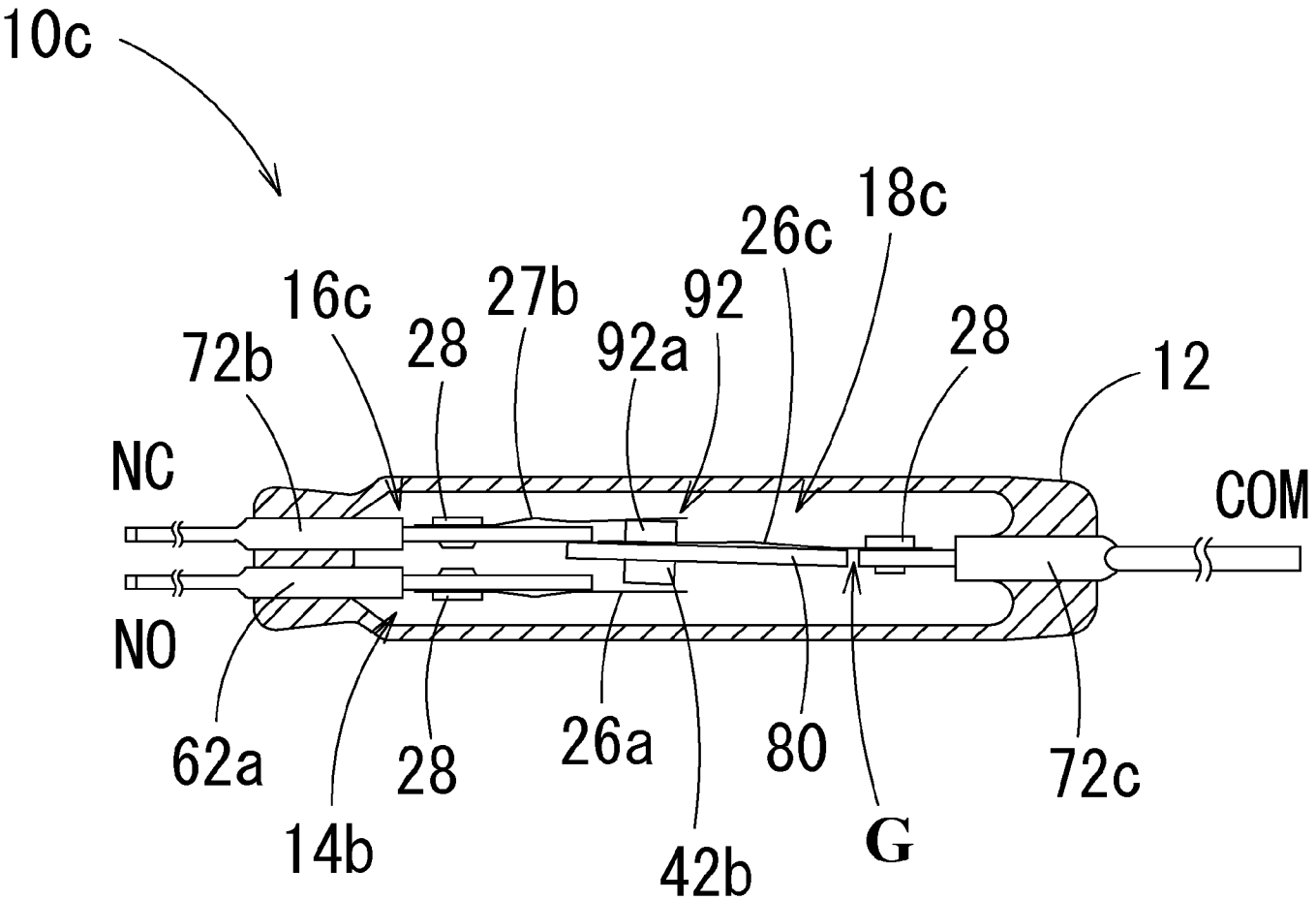
FIG. 6 is a longitudinal sectional view of the reed switch according to a third embodiment of the present invention.

The second terminal unit is a feature of the reed switch 10*c* according to the third embodiment, as compared with the reed switch 10*b* according to the second embodiment. Specifically, as shown in FIG. 6, the reed switch 10*c* has a second terminal unit 16*c*, which has a second fixed terminal piece 72*b*. The feature is that the second fixed terminal piece 72*b* inside the envelope 12 is elongated. The second fixed terminal piece 72*b*, excluding a distal end portion 94 (see FIG. 7), is made of a magnetic material or a nonmagnetic material. The distal end portion 94 of the second fixed terminal piece 72*b* is made of a nonmagnetic material.

Another feature is the shape of the second spring member 27*b* of the second terminal unit 16*c*. Specifically, the shape of the second spring member 27*b* is approximately the same as the shape of the first spring member 26*a*. The second spring member 27*b* is made of a nonmagnetic material.

The third terminal unit is another feature of the reed switch 10*c* according to the third embodiment, as compared with the reed switch 10*a* according to the first embodiment. Specifically, the reed switch 10*c* has a third terminal unit 18*c*, which has a movable reed piece 80 and a third fixed terminal piece 72*c*. The feature is that the base end portion of the movable reed piece 80 and the distal end portion of the third fixed terminal piece 72*c* are not bent. Accordingly, the magnetic gap G is defined between the end face of the base end portion of the movable reed piece 80 and the end face of the distal end portion of the third fixed terminal piece 72*c* facing the end face of the base end portion of the movable reed piece 80.

Additionally, an upper moving contact 92*a* of a moving contact 92 has a cylindrical shape.

The first spring member 26*a*, the second spring members 27*b*, and the third spring member 26*c* respectively have spring constants K1, K2, and K3, which are set as follows.

The spring constant K3 of the third spring member 26*c* is smaller than the spring constant K1 of the first spring member 26*a* (K3<K1).

The spring constant K2 of the second spring member 27*b* has a first case and a second case, namely, where the spring constant K2 is smaller than the spring constant K3 of the third spring member 26 (K2<K3<K1), and where the spring constant K2 is larger than the spring constant K1 of the first spring member 26*a* (K3<K1<K2).

An operation of the reed switch 10*c* will be described. Upon change from a state without a magnetic field applied from outside to a state with a magnetic field applied from outside, the reed switch 10*c* operates according to steps SC1 to SC5 shown in FIG. 7.

Step SC1

Without a magnetic field applied from outside, the third spring member 26*c* keeps the upper moving contact 92*a* in contact with the second spring member 27*b*. The upper side of the distal end portion (that is, a moving magnetic armature 50) of the movable reed piece 80 is in contact with the lower side of the distal end portion 94 (nonmagnetic material) of the second fixed terminal piece 72*b*.

Step SC2

With a magnetic field applied from outside, the attracting force between the magnetized movable reed piece 80 and the first fixed terminal piece 62*a* becomes larger than the thrusting force of the third spring member 26*c* against the upper moving contact 92*a* toward the second spring member 27*b*. This separates the upper moving contact 92*a* from the second spring member 27*b*. Additionally, the movable reed piece 80 separates from the distal end portion 94 of the second fixed terminal piece 72*b*.

Figure 7:
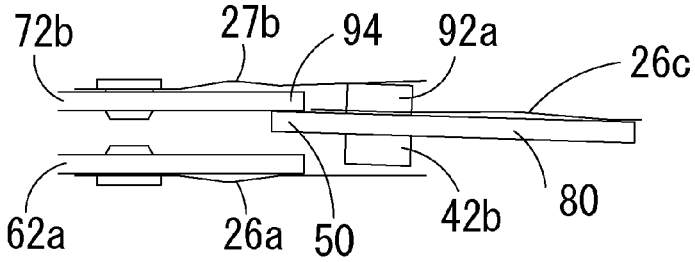
FIG. 7 is a diagram illustrating an operation of the reed switch.
Figure 7:
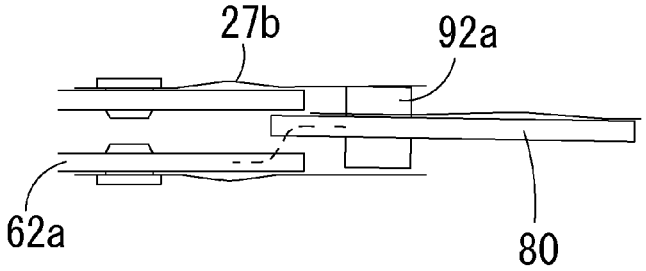
Figure 7:
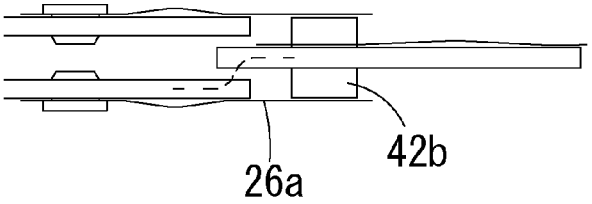
Figure 7:
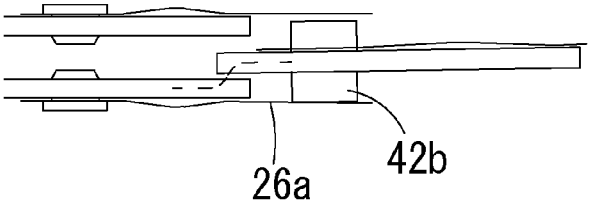
Figure 7:
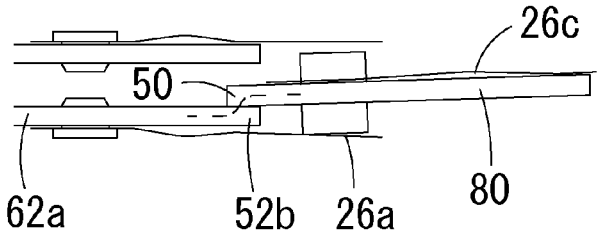

In FIG. 7, the dashed lines each indicate a part of the flux path resulting from the magnetic field applied from outside.

Step SC3

The lower movable contact portion 42*b* approaches the first spring member 26*a*.

Step SC4

The lower movable contact portion 42*b* comes into contact with the first spring member 26*a*.

Step SC5

The gap between the movable reed piece 80 and the first fixed terminal piece 62*a* diminishes. The attracting force, Fm, between the movable reed piece 80 and the first fixed terminal piece 62*a* is larger than the spring force F3 of the third spring member 26*c* and the spring force F1 of the first spring member 26*a* combined. Hence, the movable reed piece 80 thrusts down the first spring member 26*a*.

Finally, the lower side of the distal end portion (that is, a moving magnetic armature 50) of the movable reed piece 80 comes into contact with the upper side of the distal end portion (that is, a fixed magnetic armature 52*b*) of the first fixed terminal piece 62*a*.

The spring force F1 (spring constant K1) of the first spring member 26*a* is sufficiently large such that the spring constant K1 is larger than the spring constant K3 of the third spring member 26*c*, as described above. This ensures sufficient contact pressure between the moving magnetic armature 50 and the fixed magnetic armature 52*b*.

With the magnetic field no longer applied from outside, the reed switch 10*c* operates according to the steps in reverse (that is, step SC5, step SC4, step SC3, step SC2, and step SC1).

Specifically, with the magnetic field no longer applied, the movable reed piece 80 receives the combined force of the spring force F1 of the first spring member 26*a* and the spring force F3 of the third spring member 26*c*. The combined force urges the movable reed piece 80 in the direction in which to come into contact with the second spring member 27*b*. The difference between the spring force F3 of the third spring member 26*c* and the spring force F2 of the second spring member 27*b* keeps the upper moving contact 92*a* and the second spring member 27*b* in contact with one another. Additionally, the second fixed terminal piece 72*b* and the movable reed piece 80 are also kept in contact with one another.

Thus, the reed switch 10*c* is of the Form C type, where the COM terminal is coupled to the NO terminal or the NC terminal depending on the presence of an external magnetic field.

The NO terminal and the NC terminal of the reed switch 10*c* each have a "double contact structure", where two internal couplings are established, which are at the distal end portion of the movable reed piece 80 and the moving contact 92.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A reed switch comprising:

an envelope having one end and another end;

a first fixed terminal piece at the one end of the envelope, the first fixed terminal piece having one end portion inside the envelope and another end portion outside the envelope;

a second fixed terminal piece spaced apart from the first fixed terminal piece at the one end of the envelope, the second fixed terminal piece having one end portion inside the envelope and another end portion outside the envelope;

a third fixed terminal piece at the other end of the envelope, the third fixed terminal piece having one end portion inside the envelope and another end portion outside the envelope;

a movable reed piece inside the envelope, the movable reed piece having a base end portion, a distal end portion, and a movable contact portion, the base end portion facing the one end portion of the third fixed terminal piece across a magnetic gap, the distal end portion being configured to come into contact with the first fixed terminal piece, the movable contact portion being further centerward than the distal end portion in a longitudinal direction of the reed switch;

a first spring member having a base end portion secured to the first fixed terminal piece and a distal end portion configured to come into contact with the movable contact portion;

a second spring member having a base end portion secured to the second fixed terminal piece and a distal end portion configured to come into contact with the movable contact portion; and a third spring member having one end portion secured to the movable reed piece and another end portion secured to the third fixed terminal piece, wherein the first spring member, the second spring member, and the third spring member each have a different spring constant, and wherein the distal end portion of the movable reed piece is configured to not come into direct contact with the second fixed terminal.

2. The reed switch according to claim 1, wherein upon application of a magnetic field from outside the envelope, the distal end portion of the movable reed piece is configured to come into contact with the one end portion of the first fixed terminal piece, and the movable contact portion is configured to come into contact with the first spring member, and wherein without a magnetic field applied from outside the envelope, the movable contact portion is configured to come into contact with the second spring member.

3. The reed switch according to claim 2, wherein the first fixed terminal piece, the second fixed terminal piece, the third fixed terminal piece, and the movable reed piece each comprise a magnetic material, and wherein the first spring member, the second spring member, and the third spring member each comprise a non-magnetic material.

4. The reed switch according to claim 2, wherein the first spring member has a first spring constant, the second spring member has a second spring constant, and the third spring member has a third spring constant, the third spring constant being smaller than the first spring constant, the second spring constant being smaller than the third spring constant.

5. The reed switch according to claim 2, wherein the first spring member has a first spring constant, the second spring member has a second spring constant, and the third spring member has a third spring constant, the third spring constant being smaller than the first spring constant, the second spring constant being larger than the first spring constant.

6. The reed switch according to claim 1, wherein the first fixed terminal piece, the second fixed terminal piece, the third fixed terminal piece, and the movable reed piece each comprise a magnetic material, and wherein the first spring member, the second spring member, and the third spring member each comprise a non-magnetic material.

7. The reed switch according to claim 1, wherein the first spring member has a first spring constant, the second spring member has a second spring constant, and the third spring member has a third spring constant, the third spring constant being smaller than the first spring constant, the second spring constant being smaller than the third spring constant.

8. The reed switch according to claim 1, wherein the first spring member has a first spring constant, the second spring member has a second spring constant, and the third spring member has a third spring constant, the third spring constant being smaller than the first spring constant, the second spring constant being larger than the first spring constant.

9. The reed switch according to claim 1, wherein the first fixed terminal piece has a fixed reed piece fixedly attached to the one end portion of the first fixed terminal piece, and wherein the distal end portion of the movable reed piece is configured to come into direct contact with the fixed reed piece.

10. The reed switch according to claim 9, wherein the first spring member is fixedly attached to the fixed reed piece, and wherein the first spring member is configured to come into direct contact with the movable contact portion of the movable reed piece.

11. A reed switch comprising:

an envelope having one end and another end;

a first fixed terminal piece at the one end of the envelope, the first fixed terminal piece having one end portion inside the envelope and another end portion outside the envelope;

a second fixed terminal piece spaced apart from the first fixed terminal piece at the one end of the envelope, the second fixed terminal piece having one end portion inside the envelope and another end portion outside the envelope;

a third fixed terminal piece at the other end of the envelope, the third fixed terminal piece having one end portion inside the envelope and another end portion outside the envelope;

a movable reed piece inside the envelope, the movable reed piece having a base end portion, a distal end portion, and a movable contact portion, the base end portion facing the one end portion of the third fixed terminal piece across a magnetic gap, the distal end portion being configured to come into contact with the first fixed terminal piece, the movable contact portion being further centerward than the distal end portion in a longitudinal direction of the reed switch;

a first spring member having a base end portion secured to the first fixed terminal piece and a distal end portion configured to come into contact with the movable contact portion;

a second spring member having a base end portion secured to the second fixed terminal piece and a distal end portion configured to come into contact with the movable contact portion; and a third spring member having one end portion secured to the movable reed piece and another end portion secured to the third fixed terminal piece, wherein the first spring member, the second spring member, and the third spring member each have a different spring constant, wherein the first fixed terminal piece has a fixed reed piece fixedly attached to the one end portion of the first fixed terminal piece, wherein the distal end portion of the movable reed piece is configured to come into direct contact with the fixed reed piece, wherein the first spring member is fixedly attached to the fixed reed piece, wherein the first spring member is configured to come into direct contact with the movable contact portion of the movable reed piece, and wherein the distal end portion of the movable reed piece is configured to not come into direct contact with the second fixed terminal.

12. A reed switch comprising:

an envelope having one end and another end;

a first fixed terminal piece at the one end of the envelope, the first fixed terminal piece having one end portion inside the envelope and another end portion outside the envelope;

a second fixed terminal piece spaced apart from the first fixed terminal piece at the one end of the envelope, the second fixed terminal piece having one end portion inside the envelope and another end portion outside the envelope;

a third fixed terminal piece at the other end of the envelope, the third fixed terminal piece having one end portion inside the envelope and another end portion outside the envelope;

a movable reed piece inside the envelope, the movable reed piece having a base end portion, a distal end portion, and a movable contact portion, the base end portion facing the one end portion of the third fixed terminal piece across a magnetic gap, the distal end portion being configured to come into contact with the first fixed terminal piece, the movable contact portion being further centerward than the distal end portion in a longitudinal direction of the reed switch;

a first spring member having a base end portion secured to the first fixed terminal piece and a distal end portion configured to come into contact with the movable contact portion;

a second spring member having a base end portion secured to the second fixed terminal piece and a distal end portion configured to come into contact with the movable contact portion; and a third spring member having one end portion secured to the movable reed piece and another end portion secured to the third fixed terminal piece, wherein the first spring member, the second spring member, and the third spring member each have a different spring constant, wherein the first fixed terminal piece has a fixed reed piece fixedly attached to the one end portion of the first fixed terminal piece, wherein the distal end portion of the movable reed piece is configured to come into direct contact with the fixed reed piece, and wherein the distal end portion of the movable reed piece is configured to not come into direct contact with the second fixed terminal.

* * * * *